US007036806B2

(12) United States Patent
Amherd et al.

(10) Patent No.: US 7,036,806 B2
(45) Date of Patent: May 2, 2006

(54) PRESS TOOL COMPRISING A SPINDLE FOR MOULDING COUPLING ELEMENTS

(75) Inventors: Rene Amherd, Reutlingen (CH); Paul Dummermuth, Zunzgen (CH)

(73) Assignee: Von Arx AG, Sissach (CH)

( * ) Notice: Subject to any disclaimer, the term of this patent is extended or adjusted under 35 U.S.C. 154(b) by 121 days.

(21) Appl. No.: 10/477,769

(22) PCT Filed: Jun. 4, 2002

(86) PCT No.: PCT/CH02/00291

§ 371 (c)(1),
(2), (4) Date: Nov. 14, 2003

(87) PCT Pub. No.: WO02/102555

PCT Pub. Date: Dec. 27, 2002

(65) Prior Publication Data

US 2004/0144146 A1 Jul. 29, 2004

(30) Foreign Application Priority Data

Jun. 19, 2001 (CH) ..... 1114/01

(51) Int. Cl.
*B25B 1/00* (2006.01)

(52) U.S. Cl. ..... 269/6; 269/3

(58) Field of Classification Search ..... 269/6, 269/3, 95–97, 32, 20, 298 R, 43
See application file for complete search history.

(56) References Cited

U.S. PATENT DOCUMENTS

| | | | | |
|---|---|---|---|---|
| 4,738,438 | A | 4/1988 | Horie et al. | |
| 4,770,401 | A * | 9/1988 | Donaldson | 269/249 |
| 5,125,324 | A * | 6/1992 | Araki et al. | 91/454 |
| 5,477,680 | A * | 12/1995 | Heskey et al. | 60/452 |
| 6,035,775 | A * | 3/2000 | Nghiem | 100/43 |
| 6,510,719 | B1 * | 1/2003 | Goop | 72/3 |
| 6,510,723 | B1 * | 1/2003 | Amherd | 72/453.16 |
| 2002/0148274 | A1 * | 10/2002 | Goop | 72/416 |
| 2003/0066324 | A1 * | 4/2003 | Goop | 72/3 |

* cited by examiner

*Primary Examiner*—Lee D. Wilson
(74) *Attorney, Agent, or Firm*—Pauley Peterson & Erickson

(57) ABSTRACT

An electrically driven press tool that is compact, reliable and cost-effective. There is a press tool in which a crimping tool is retained in a recess by a bolt. An electromotor drives a spindle, which interacts with the crimping tool, by a reducing gear. The spindle is connected to a shaft by a pressure flange. The bearing pressure, which acts on the spindle, is brought to bear on a pressure ring by a pressure flange and a pressure bearing, the ring acting directly or indirectly on a force or pressure sensor. When a predetermine set value of the crimping is reached, the sensor forwards a switching signal to the controller of the drive motor.

9 Claims, 2 Drawing Sheets

PRESS TOOL COMPRISING A SPINDLE FOR MOULDING COUPLING ELEMENTS

BACKGROUND OF THE INVENTION

1. Field of the Invention

This invention relates to an electrically operated pressing tool for connecting tubular workpieces, with a fork-like receiver, with a clamping pincer exchangeably held in the receiver by a connection bolt, and with a controlled electric drive motor for actuating the clamping pincer, wherein there is a spindle driven by an electric drive motor via a reduction gear and which is in active connection with the clamping pincer.

2. Discussion of Related Art

Portable, electrically functioning pressing tools are used for pressing coupling elements such as press sleeves, press fittings, connecting sleeves, tube sections inserted into one another and likewise. The pressing tools have a clamping pincer with clamping jaws which form a pressing space for receiving the coupling element to be pressed. A pressing pressure required for the pressing is initially produced by an electric motor connected to the mains, via a forward and rearward running spindle which acts on a yoke having two rollers, wherein the rollers move the clamping jaws of the clamping pincer.

These pressing tools are proven and are extremely widespread. Through development pressing tools have moved more and more from spindle-operated versions to hydraulically operated versions. With these hydraulically functioning tools one operates with an electromotoric drive which actuates a pump that displaces a piston having a piston rod that acts on the yoke in which the two rollers are mounted. These hydraulically operated pressing tools may be controlled precisely by a combined monitoring of the hydraulic pressure to be built up as well as the monitoring of the path which checks an exact closure of the clamping pincer.

A further advantage of hydraulically functioning pressing tools is that battery-operated electric motors may also be applied, by which one may operate independently of the mains. With the hydraulic drive one may also apply battery-operated electric motors which initially have a relatively low torque.

For all previously mentioned pressing tools, one applied different clamping pincers corresponding to a large number of different coupling elements for a large range of the most varied of diameters. The diameters of common coupling elements are in the range of 10 to more than 100 mm. The most common range of application however is between 10 and 30 mm. However, practically all pressing tools offered on the market today are designed for the complete application range. Accordingly, the pressing tools known today are relatively large and heavy. Although there exists a corresponding demand for portable, smaller and lighter pressing tools for the most common range between, for example 10 and 50 mm diameter of the coupling elements, such apparatus are not obtainable on the market until today because the safety issues and monitoring of the pressure which is built up by the pressing tools. The high pressures built up with hydraulic systems require a correspondingly heavy and safe design of the pressing tool and a corresponding reduction which with respect to scale is not possible without using completely different clamping pincers. In order to obtain the required safety with spindle-operated pressing tools, between the electric motor and the spindle there is arranged a clutch in front of or after the gear, for safety reasons. This has made the spindle-operated apparatus heavier, more expensive and larger. Various suppliers have brought this type of apparatus to the market.

From U.S. Pat. No. 6,035,775 there is known a pressing tool functioning with a spindle, with which the built up pressure is electronically monitored because the rotation speed of the electric motor is monitored and is controlled with a predefined profile within a certain bandwidth. These pressing characteristics are essentially dependent on the size, shape and nature of the material of the coupling elements and thus permit a pressing procedure which is carried out in a pressure-dependent and time-dependent manner.

SUMMARY OF THE INVENTION

It is one object of this invention to modify the design of a pressing tool so that it may be constructed smaller, at a lesser cost and lighter without sacrificing safety aspects.

This object is achieved with a pressing tool of the type described in this specification and in the claims, and as shown in the drawings.

BRIEF DESCRIPTION OF THE DRAWINGS

The drawings show one preferred embodiment of this invention, wherein.

DETAILED DESCRIPTION OF PREFERRED EMBODIMENTS

Figure 1:
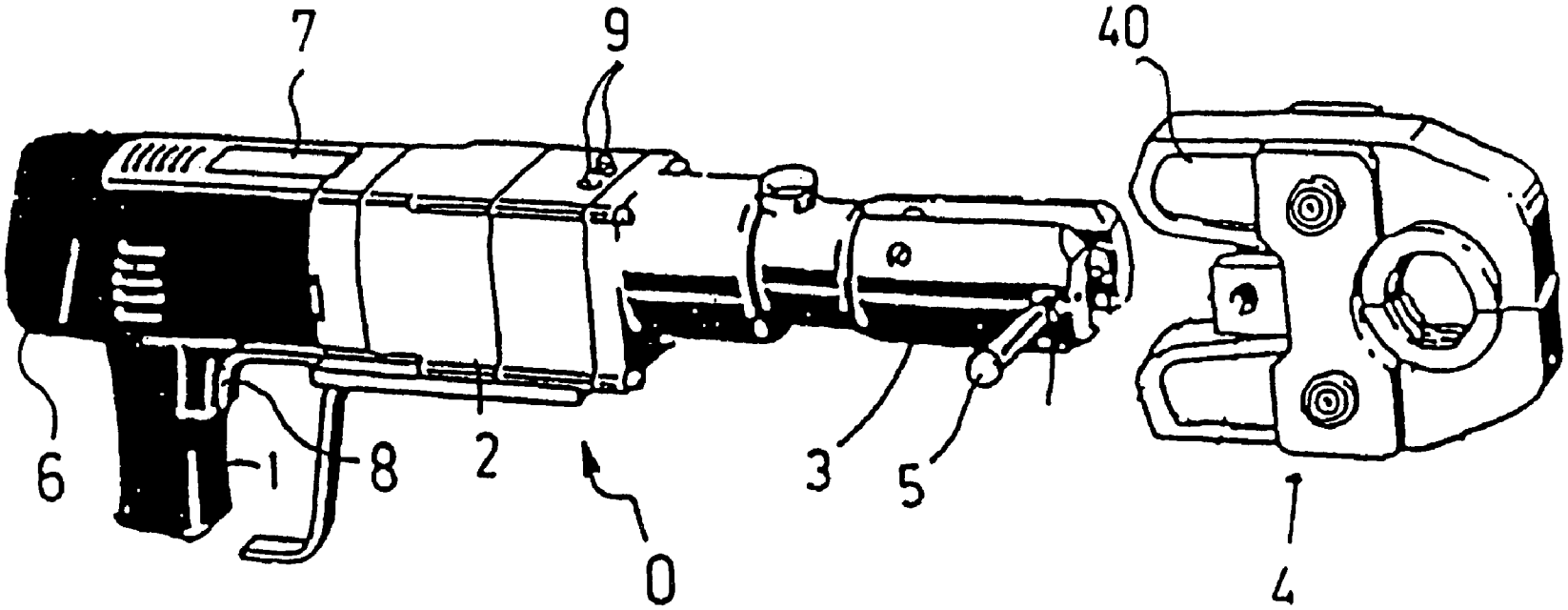
FIG. 1 shows one embodiment of the pressing tool in a perspective view.

The pressing tool 0 is an electromechanical apparatus which can be a battery-operated apparatus. The pressing tool 0 has a pressing tool function unit 2 on which a grip 1 is integrally formed. In the rearward extension, a battery housing 6 is integrally formed on the function unit 2 as a removable part. In the forward extension of the pressing tool function unit 2 there is a fork-like receiver 3. A clamping pincer 4 is held in the fork-like receiver 3, securely by a monitored safety bolt 5. A trigger switch 8 is for actuating the apparatus. The functional condition of the pressing tool is displayed on a display unit 7, while light diodes inform an user whether a pressing can be carried out correctly or not.

Figure 2:
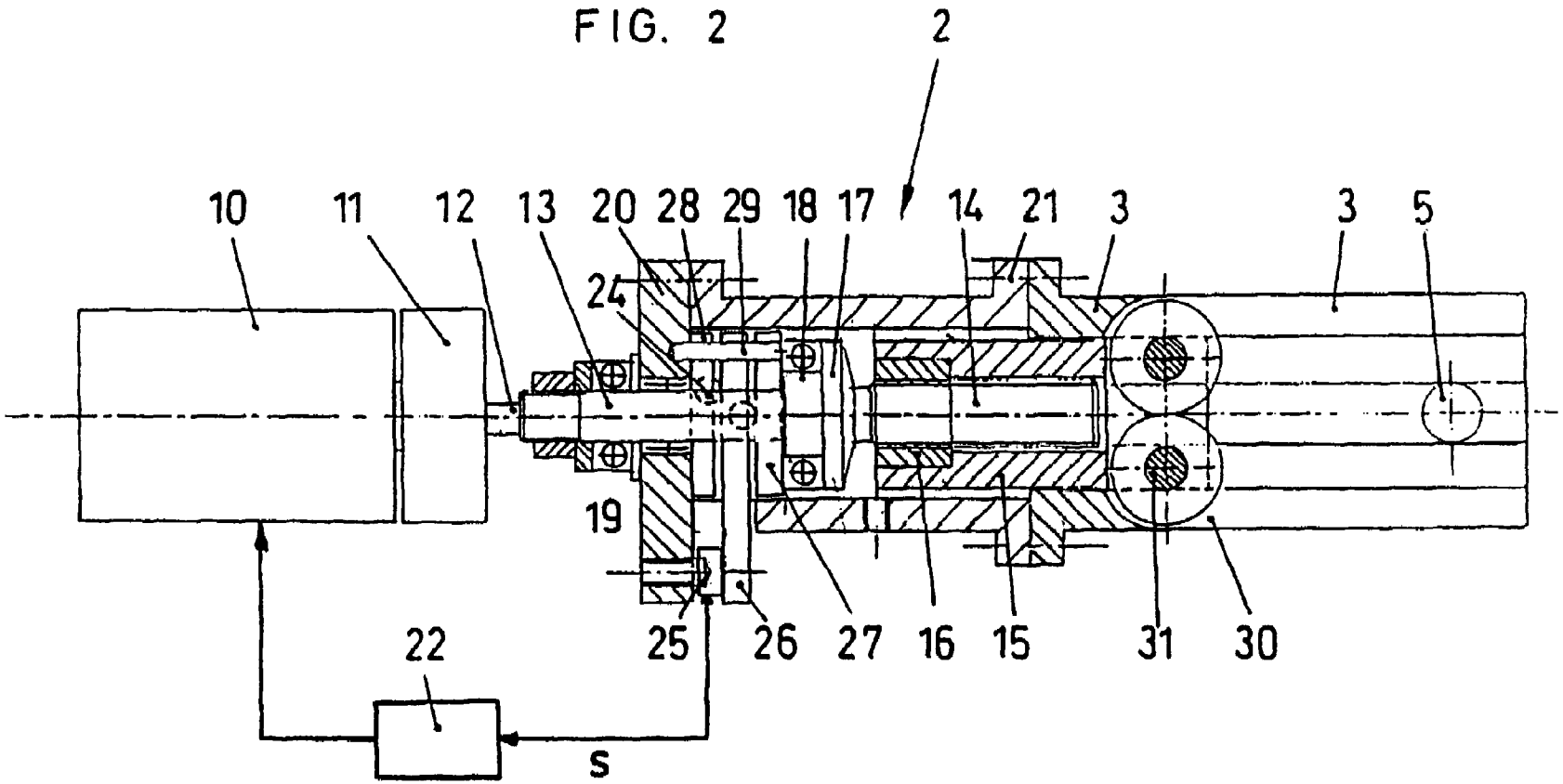
FIG. 2 shows an axial longitudinal section view, taken through the spindle drive in a simplified representation.

The construction of the function unit 2 is shown in detail from FIG. 2. As shown from the left to the right in the drawing of FIG. 2, the electric drive motor 10 acts on a shaft 13 via a reduction gear 11 and its drive pinion 12. The shaft 13 drives a threaded spindle 14 on which a spindle nut 16 runs and displaces a roller advance element 15 which is translatorily moved into the fork-like receiver 3.

The electric motor 10 may be designed infinitely as a d.c. or an a.c. motor, preferably an electric motor with a lower mass and a high torque. Such motors are obtainable on the market in varied forms. The output drive of the electric motor 10 is effected onto a reduction gear 11. Thus a completely traditional gear is connected to a shaft 13 via a drive pinion 12. The connection between the drive pinion 12 and the shaft 13 may be a simple, practically play-free plug connection. The shaft 13 is preferably manufactured as one piece and axially flush with the threaded spindle 14. The threaded spindle 14 has a trapezoid thread suitable for transmitting large forces. In contrast to conventional pressing tools, here one does not operate with ball-bearing spindles, but with a simple and inexpensive threaded spindle 14. A spindle nut 16 which is seated on the threaded spindle 14 runs forwards or backwards on the spindle 14 according to the drive. The threaded spindle 16 is rigidly connected to a roller advance element 15. The roller advance element 15 at the same time is the spindle and a part of the shaft 13 is mounted in a spindle housing 21. To this spindle housing 21 is connected the fork-like receiver 3 into which the roller advance element 15 advancingly and retreatingly moves. The roller advance element 15 is passed through by axis pins 31 on which rollers 30 are mounted, which cooperate with clamping jaws 40 of the clamping pincer 4 and accordingly closes the clamping pincer 4.

While the spindle housing 21 which forms part of the housing of the function unit 2 in the direction of the clamping pincer 4 is limited by the fork-like receiver 3, on the motor side the spindle housing 21 is closed off by a housing plate 20. The shaft 13 passes through the housing plate 20 and is mounted in the housing plate 20 itself in a radial bearing 19. The shaft 13 is limited towards the spindle 14 by a pressure flange 17. Between the pressure flange 17 and the housing plate 20 lies an axial thrust bearing 18, a thrust ring 27 which acts directly or indirectly onto a force sensor or pressure sensor 25. With regard to design, this may be effected simply with annular force or pressure sensors present on the market which one would arrange between the thrust ring 27 and the housing plate 20. Such force or pressure sensors are quite expensive but according to this invention, one may operate with a small and extremely inexpensive piezoelectric force and pressure sensor 25. However, a wire strain gauge could be used as a force sensor. For this purpose, a lever 26 and a counter-pressure ring 28 are provided between the thrust ring 27 and the housing plate 20. The relative position of the lever 26, of the thrust ring 27 and of the counter-pressure ring 28 is rotationally secured by a pin 29, wherein the pin 29 engages into the housing plate 20. Balls 24 are applied between the counter-pressure ring 28 and the lever 26 on one side and between the lever 26 and the thrust rung 27 on the other side, and the balls 24 permit a pivot movement of the lever 26.

If a user actuates the trigger switch 8, then the electric motor 10 via the reduction gear 11 drives the shaft 13 and the threaded spindle 14, by which the spindle nut 16 slides forwards in the direction of the fork-like receiver and thus the roller advance element with the rollers 30 is moved to the right in FIG. 2. The rollers 30 run on the cheeks of the clamping jaw 40 of the clamping pincer 4 and close. The reaction force leads to an increased pressure of the spindle 14 and thus of the pressure flange 17 connected onto the thrust bearing 18 which transfers this pressure further onto the thrust ring 27. The entire pressure is finally led onto the rigid housing plate 20. As mentioned, either the reaction force of the ring 27 is led directly onto a force or pressure sensor 25, or as shown the pressure is effected via the lever system with the balls 24, wherein the lever 26 carries out a slight pivot movement or a slight deformation which leads to a pressure on the force or pressure sensor 25. If the pressure reaches a predefined limit value, then a signal S is released by the force or pressure sensor 25 to a control 22 and the control 22 leads to a reversing of the electric motor 10 which then rotates in the counter direction. Thus, the threaded spindle 14 runs in the reverse rotational direction and the spindle nut 16 accordingly runs back into the initial position.

With the pressure monitoring achieved, it is ensured that the connection elements are pressed with the required pressure. This alone is not sufficient. Additionally although not shown here, the complete closure of the clamping pincer is also monitored, as known. Such a monitoring may be effected by suitable sensors on the clamping pincer or a path monitoring may be effected. With the path monitoring, in this case, the displacement path of the roller advance element 15 may be monitored by suitable sensors. This sensor which is not shown also conveys the corresponding information to the control 22, wherein any falling short of the required path leads to a corresponding error notification.

The invention claimed is:

1. An electrically operated pressing tool (0) comprising: a spindle (14) for connecting tubular workpieces, with a fork-shaped receiver (3), a clamping pincer (4) exchangeably held in the fork receiver (3) by a connection bolt (5) and with a controlled electric drive motor (10) for actuating the clamping pincer (4), a spindle (14) driven by the electric drive motor (10) via a reduction gear (11) in active connection with the clamping pincer (4), the spindle (14) connected to the gear (11) via a shaft (13), the shaft (13) passing through at least one radial bearing (19) and an axial thrust bearing (18) supported on a housing (21) of the pressing tool, and between the thrust bearing (18) and the support on the housing (20, 21) a force or pressure sensor (25) arranged which on reaching a predefined nominal value of the clamping force emits a switching signal (S) to a control (22) of the electric drive motor (10).

2. A pressing tool according to claim 1, wherein the spindle (14) and the shaft (13) are connected flush to one another as one piece.

3. A pressing tool according to claim 2, wherein on the shaft (13) near the spindle there is integrally formed a pressure flange (17) and the shaft (13) passes through a housing plate (20), wherein between the pressure flange (17) and the housing plate (20) lies the axial thrust bearing (18) which on one side is supported on the pressure flange (17) and on an other side is supported by the force or pressure sensor (25) on the housing plate (20).

4. A pressing tool according to claim 3, wherein the force or pressure sensor (25) is a cylindrical element surrounding the shaft (13).

5. A pressing tool according to claim 3, wherein the force or pressure sensor (25) is arranged between the housing plate (20) and a lever (26).

6. A pressing tool according to claim 5, wherein the force or pressure sensor (25) is a piezoelectric sensor.

7. A pressing tool according to claim 1, wherein the threaded spindle (14) is a screw spindle with a trapezoid thread and engages into an axially displaceably mounted spindle nut which acts on the clamping pincer (4) via a roller advance element (15).

8. A pressing tool according to claim 1, wherein the threaded spindle (14) is a circulating ball spindle.

9. A pressing tool according to claim 1, wherein the force or pressure sensor (25) is a wire strain gauge.

* * * * *